US007909269B2

(12) United States Patent
Erickson et al.

(10) Patent No.: US 7,909,269 B2
(45) Date of Patent: Mar. 22, 2011

(54) FAUCET SPRAY CONTROL ASSEMBLY

(75) Inventors: Perry D. Erickson, Sheboygan, WI (US); David E. Hansen, Howards Grove, WI (US); Patrick H. Montag, Hartford, WI (US)

(73) Assignee: Kohler Co., Kohler, WI (US)

( * ) Notice: Subject to any disclaimer, the term of this patent is extended or adjusted under 35 U.S.C. 154(b) by 255 days.

(21) Appl. No.: 11/533,100

(22) Filed: Sep. 19, 2006

(65) Prior Publication Data

US 2008/0067264 A1 Mar. 20, 2008

(51) Int. Cl.

| | |
|---|---|
| ***A62C 31/00*** | (2006.01) |
| ***B05B 7/02*** | (2006.01) |
| ***F15B 13/00*** | (2006.01) |
| ***E03C 1/04*** | (2006.01) |

(52) U.S. Cl. ..... 239/449; 239/443; 239/444; 239/445; 239/446; 239/525; 239/391; 4/678; 137/801

(58) Field of Classification Search ..... 239/444, 239/445, 446, 447, 448, 449, 525, 391, 396, 239/443, 527, 528; 4/676, 677, 678; 137/801
See application file for complete search history.

(56) References Cited

U.S. PATENT DOCUMENTS

| | | | | |
|---|---|---|---|---|
| 2,969,809 | A | | 1/1961 | Klingler |
| 3,140,830 | A | | 7/1964 | Ingold |
| 4,204,646 | A | | 5/1980 | Shames et al. |
| 4,765,513 | A | | 8/1988 | McMillin et al. |
| 5,145,114 | A | | 9/1992 | Moench |
| 5,158,234 | A | | 10/1992 | Magnenat et al. |
| 5,383,604 | A | * | 1/1995 | Boesch ..... 239/447 |
| 5,575,424 | A | | 11/1996 | Fleischmann |
| 5,690,312 | A | | 11/1997 | Yang |
| 5,707,011 | A | * | 1/1998 | Bosio ..... 239/447 |
| 5,806,771 | A | | 9/1998 | Loschelder et al. |
| 5,937,905 | A | | 8/1999 | Santos |
| 6,045,062 | A | | 4/2000 | Bosio |
| 6,085,790 | A | * | 7/2000 | Humpert et al. ..... 137/801 |
| 6,145,757 | A | | 11/2000 | Knapp |

(Continued)

FOREIGN PATENT DOCUMENTS

EP 1418008 5/2004

(Continued)

OTHER PUBLICATIONS

PCT International Search Report, Form PCT/US2007/019775.

(Continued)

*Primary Examiner* — Jason J Boeckmann
*Assistant Examiner* — Ryan Reis
(74) *Attorney, Agent, or Firm* — Quarles & Brady LLP

(57) ABSTRACT

A pull-out faucet has a spray head with spray selection and pause control. A spring-loaded push button interrupts outlet spray entirely as long as it is being depressed. A rocker button controls spray through inner and outer sets of outlet orifices, for example, giving the user the option of an aerated water jet or an unaerated shower. The rocker button mounts on an integral pivot post of a valve body that houses a diverter valve that is controlled by the rocker button. The rocker button has a pair of legs that extend through openings in the valve body to engage a groove in the diverter valve. Pivoting the rocker button about a pivot axis by depressing either its forward or aft portion, moves the diverter valve along a valve axis to route flow to either the inner or outer orifices.

11 Claims, 6 Drawing Sheets

U.S. PATENT DOCUMENTS

| | | | | |
|---|---|---|---|---|
| 6,151,729 | A * | 11/2000 | Yean | 4/675 |
| 6,290,147 | B1 | 9/2001 | Bertrand et al. | |
| 6,296,011 | B1 | 10/2001 | Esche et al. | |
| 6,370,713 | B2 * | 4/2002 | Bosio | 4/677 |
| 6,568,605 | B1 | 5/2003 | Chen | |
| 6,659,373 | B1 | 12/2003 | Heren et al. | |
| 6,691,933 | B1 | 2/2004 | Bosio | |
| 6,738,996 | B1 * | 5/2004 | Malek et al. | 4/677 |
| 6,796,515 | B2 | 9/2004 | Heren et al. | |
| 6,935,375 | B2 | 8/2005 | Blessing | |
| 6,938,837 | B2 | 9/2005 | Nelson et al. | |
| 7,000,854 | B2 | 2/2006 | Malek et al. | |
| 7,070,125 | B2 | 7/2006 | Williams et al. | |
| 7,104,473 | B2 | 9/2006 | Bosio | |
| 2001/0020302 | A1 | 9/2001 | Bosio | |
| 2004/0112985 | A1 | 6/2004 | Malek et al. | |
| 2005/0103896 | A1 | 5/2005 | Bosio | |
| 2005/0103905 | A1 | 5/2005 | Bosio | |
| 2005/0178857 | A1 | 8/2005 | Roman | |
| 2005/0189438 | A1 | 9/2005 | Bosio | |
| 2006/0016912 | A1 | 1/2006 | Nobili | |
| 2007/0193640 | A1 | 8/2007 | Malek | |
| 2007/0194148 | A1 | 8/2007 | Rosko et al. | |
| 2008/0067264 | A1 | 3/2008 | Erickson et al. | |

FOREIGN PATENT DOCUMENTS

| | | |
|---|---|---|
| EP | 1418007 | 5/2005 |
| EP | 1825919 | 8/2007 |
| FR | 2453680 | 11/1980 |

OTHER PUBLICATIONS

European Search Report, under Jan. 12, 2010 date of mailing. European Patent Application No. 09014175.5-1268. Application to be published Feb. 17, 2010.

PCT International Search Report, PCT/US2009/000895, filed Dec. 2, 2009.

Office Action, dated Oct. 4, 2010, for U.S. Appl. No. 12/368,068.

* cited by examiner

FAUCET SPRAY CONTROL ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to faucets, and in particular to faucets with spray heads providing spray control.

Conventional faucets have a faucet body, one or more flow control/mixing valves, one or more control handles, and a spout. The spout acts a conduit for expelling water that has passed through the valve(s), in which case the outflow is either fixed to begin at a single point, or in the case of a pivotal spout is limited to begin over a range of a prescribed horizontal arc.

Faucets have conventionally been provided with separate stand-alone hand-held sprayers to provide the user with more flexibility with regard to the direction and point that outflow begins, particularly to facilitate spraying down dishware. These sprayers have a flexible hose attached to the spray head allowing the spray head to be pulled from a mount and moved about as needed. However, these faucets require extra room on the counter top for the sprayer mounting, as well as a separate hole through the counter top.

As an alternative, faucets with pull-out spray heads projecting from the main faucet body have been developed. See generally U.S. Pat. Nos. 5,213,26,8; 5,546,978; 5,758,690 and 6,370,713. The first two of these references have the sprayer unit extend from the side of the faucet body, and the latter two have the sprayer unit extend from the upper end of the faucet body.

Assembly of such pull-out faucets is usually more complicated then conventional faucets due to the added valve and spray control hardware required to be packed in the faucet. Also, separate fasteners are ordinarily needed to install the valve assembly in the faucet body.

U.S. Pat. No. 6,738,996 discloses a pull-out type faucet with a spray head that has a temporary flow interrupting control, or "pause" button, and a flow diverter control to route flow to different discharge orifices of the spray head. The diverter control is a push button type control that is depressed perpendicular to the axis along with the valve member moves. Depressing the button once moves a trigger to cam against a toggle member and drive the valve in one direction. The toggle changes states during this operation so that the next time the button is depressed it causes the trigger to move the valve in the opposite direction.

This arrangement is rather complex and is susceptible to incomplete or inconsistent actuation of the valve if the toggle does not move into the proper position following the previous actuation. Moreover, the user undertakes the same motion, a straight downward push of the button, to select both flows. Consequently, it is not readily apparent which flow will be selected with each push of the button.

A need therefore exists for an improved spray control assembly for a faucet, particularly a pull-out type faucet.

SUMMARY OF THE INVENTION

The present invention provides a spray control assembly for a faucet having a faucet body and a spray head in communication with a water line. The spray assembly has a hollow spray head body holding a valve body and an outlet. The valve body has an axial valve cavity where the diverter valve can slide along a valve axis to seat and unseat its sealing surface(s) and control the flow from an inlet opening, through a passage to an outlet opening of the valve body. A diverter button that is accessible through an opening in the spray head body can be operated to move the diverter valve and route flow to either an inner set of spray orifices and an outer set of spray orifices.

The diverter button is pivotally mounted to the valve body to so it can rock between first and second angular positions. A leg extends down from the diverter button to engage the diverter valve. When the diverter button is in the first angular position, one sealing surface of the diverter valve is seated in one valve seat, and when it is in the second angular position a second sealing surface is seated in a second vale seat. Water can pass from the valve body to the outer spray orifices when the diverter valve is in the position associated with the first angular position of the diverter button. Water can pass to the inner spray orifices when the diverter valve is in the position associated with the second angular position of the diverter button.

The valve body can define a pivot post extending toward the button opening in the spray head body that defines a pivot axis about which the diverter button pivots. The diverter button has a forward portion and an aft portion. The forward portion is at a first side of the pivot axis nearest the outlet and the aft portion is at a second side of the pivot axis opposite the outlet. Depressing the aft portion of the diverter button moves the diverter valve along the valve axis to a first axial position nearer the outlet to seat the first sealing surface of the diverter valve in the first valve seat. Depressing the forward portion of the diverter button moves the diverter valve along the valve axis to a second axial position away from the outlet to seat the second sealing surface in the second valve seat.

The body of the diverter valve can have a circumferential groove between its ends. And, the diverter button can have a pair of legs extending through one or more openings in the valve body transversely with respect to the valve axis at opposite sides of the diverter valve. The legs have feet extending essentially parallel to the pivot axis that fit into the circumferential groove in the diverter valve.

The spray control assembly can also have a pause assembly for temporarily interrupting flow to the outlet when depressed. The pause assembly includes a pause button accessible through an opening in the spray head body. The pause button is connected to a pause valve disposed along a second valve axis that is essentially perpendicular to the valve axis of the diverter valve. The pause valve can be moved to a first position in which its sealing surface seats against an associated valve seat so as to close off flow from the inlet opening of the valve body to the outlet opening of the valve body. The pause valve returns under the force of a spring to a second position in which the sealing surface is unseated from the associated valve seat so as to allow flow to pass from the inlet opening of the valve body to the outlet opening of the valve body.

The spray control assembly is particularly suitable for kitchen faucets (albeit also useful for other plumbing applications such as bathtubs), where the spray head is connected to water supply lines by a flexible hose disposed inside the faucet. This allows the spray head to be pulled out from the faucet to change the location and reach of the spray head.

These and still other advantages of the invention will be apparent from the detailed description and drawings. What follows is a preferred embodiment of the present invention.

To assess the full scope of the invention the claims should be looked to as the preferred embodiment is not intended as the only embodiment within the scope of the invention.

DETAILED DESCRIPTION OF THE PREFERRED EMBODIMENT

Figure 1:
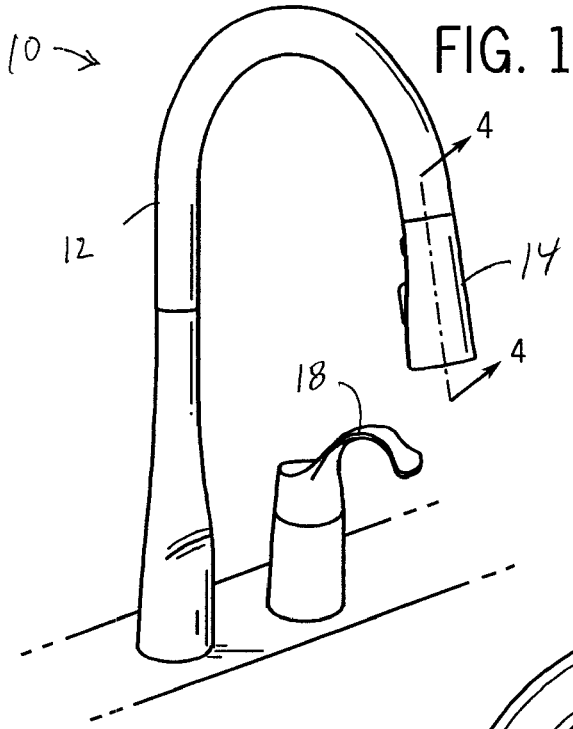
FIG. 1 is a front perspective view of a pull-out faucet having a spray head according to the present invention.
Figure 2:
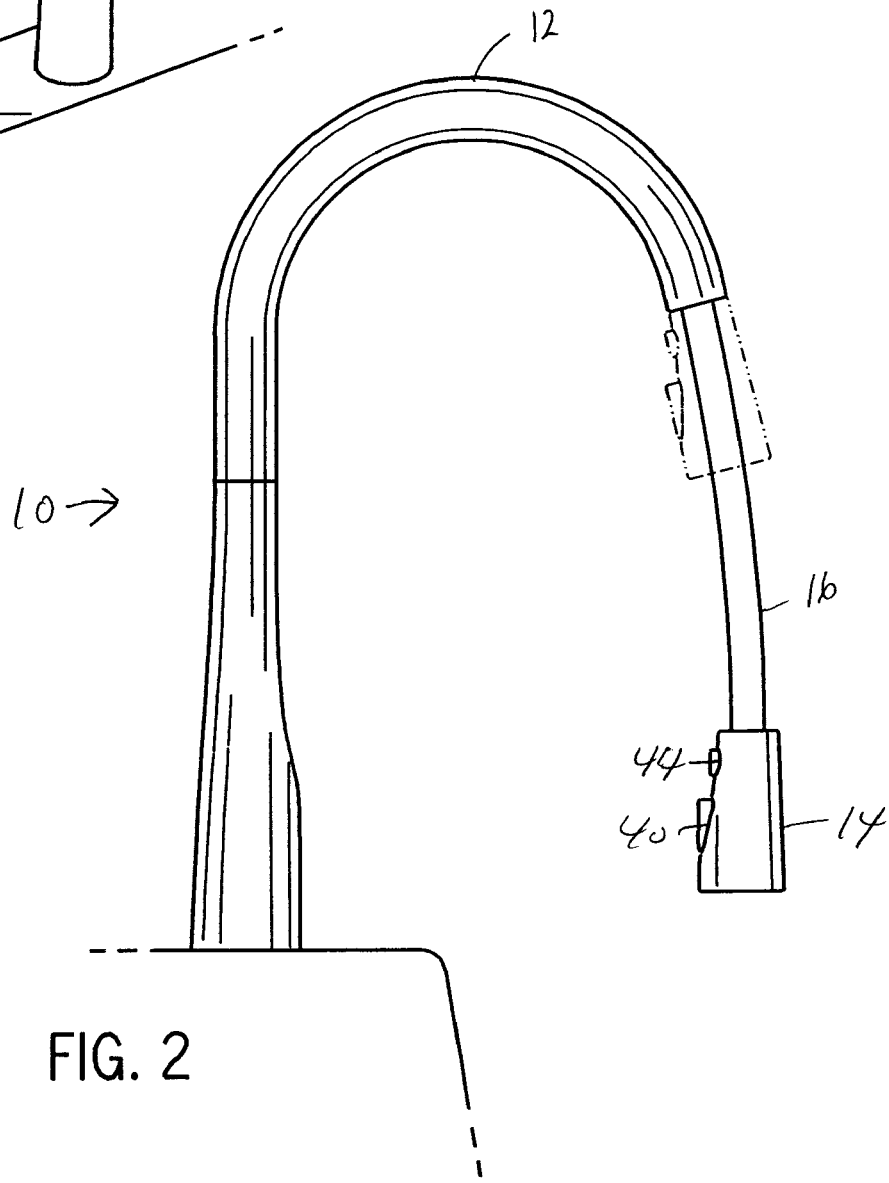
FIG. 2 is a side elevational view thereof showing the spray head in a pulled out position and a retracted position (in phantom)

FIG. 1 shows a preferred version of a pull-out faucet 10 having a cane-shaped spout body 12 and a spray head 14. As shown in FIG. 2, the faucet's spray head 12 can be pulled, in this case downwardly at first, from the retracted position shown in FIG. 1 to an extended position. The faucet 10 can thus be used as a conventional faucet in which the spray head 14 is mounted to the spout 12, or with the spray head 14 separated from the spout 12 to be moved freely, limited only by the length of the attached spray hose 16 connected via a primary valve to water inlet line(s) of the building's plumbing system.

Any water mixing components of the spout 14 and the weighted flexible lines that provide for the pull-out feature of the faucet 10 can be generally of the type disclosed in U.S. Pat. No. 6,757,921, hereby incorporated by reference as though fully disclosed herein, and are commercially available from Kohler Company of Kohler, Wis. Briefly, as is conventional, the faucet 10 can have an attached or separate control handle 18 (shown in FIG. 1) used to control mixing of hot and cold water. Separate hot and cold water lines are connected to a mixing valve (not shown) controlled via the handle 18 by the user. The weighted hose 16, sized to be longer than the spout 12, extends from the outlet side of the mixing valve through the hollow interior of the spout 12 and is connected to the inlet side of the spray head 14. Over-sizing the hose 16 allows the spray head 14 to be pulled out from the spout 12.

Figure 3:
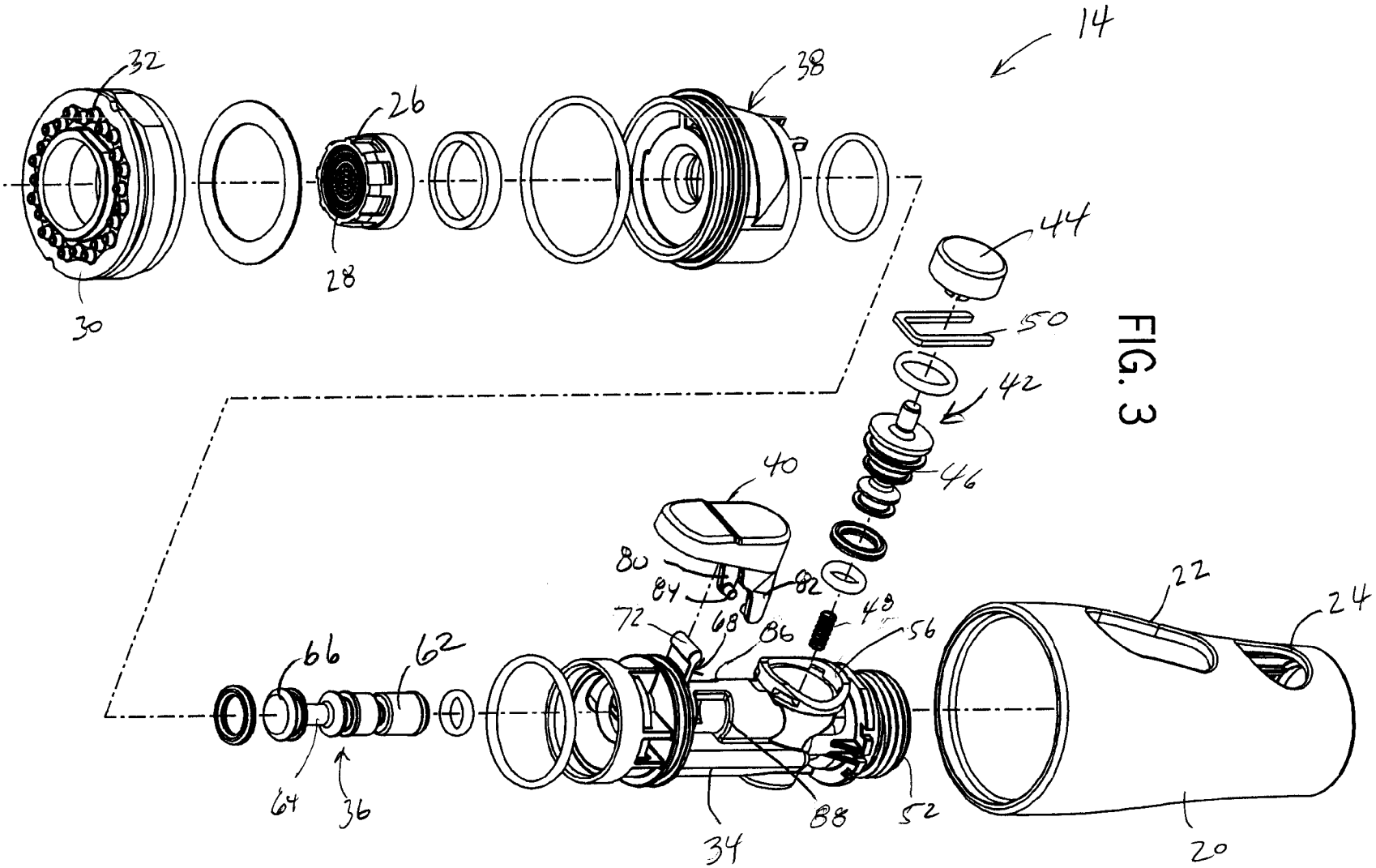
FIG. 3 is an exploded perspective view of the spray head.

Turning now to the construction and operation of the spray head 14, with reference to FIG. 3, the spray head 14 has an outer shell 20 that is open at each end and has two openings 22 and 24 through its annular wall. The outlet end of the spray head 14 has an outlet defined by an aerator cartridge 26 (as known in the art) with inner discharge orifices 28 and an outlet ring 30 with outer discharge orifices 32. Flow through the aerator cartridge 26 provides an aerated column or stream pattern and the outlet ring 30 provides a shower-like spray pattern.

A valve body 34, a diverter valve assembly 36, a flow restrictor 38 having two spaced apart valve seats 39 and 41 (see FIG. 4) and various seals, gaskets and rings (as shown) are housed inside the shell 20. A diverter or spray selector rocker button 40 and a pause assembly 42 for controlling flow through the spray head 14 are accessed through openings 22 and 24, respectively, in the shell 20. The pause assembly 42 includes pause button 44 that the user depresses to move a plunger valve 46 against a return spring 48. The plunger valve 46 clips in place and carries o-rings or other seals (in associated circumferential grooves) to keep water from flowing out of the opening 24.

Figure 4:
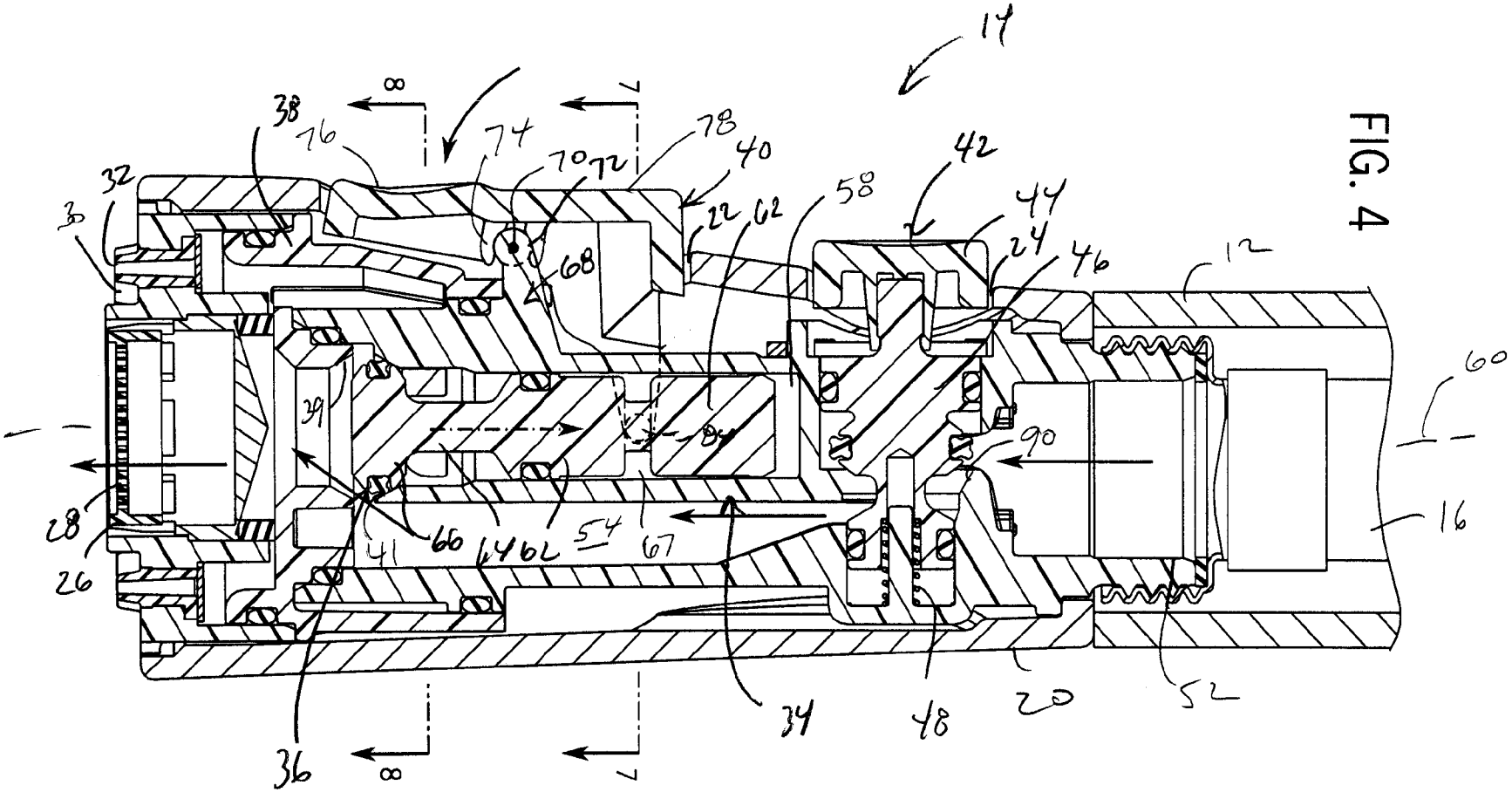
FIG. 4 is a sectional view of the spray head taken along line 4-4 of FIG. 1 showing the spray head in its normal position in which a diverter valve is positioned to route flow to an inner set of discharge orifices.

Referring to FIGS. 3 and 4, the valve body 34 has a threaded inlet opening 52 to which the hose 16 attaches. The valve body 34 also defines a passageway 54 from the inlet opening 52 to its opposite open end where water can flow through to the outlet of the spray head 14. The pause assembly 42 fits into a transverse cavity 56 in the valve body 34 that aligns with the opening 24 in the shell 20. The transverse cavity 56 intersects the passageway 54 such that the plunger valve 46 can control flow therethrough, as described below. The valve body 34 also defines an axial cavity 58 wherein the diverter valve assembly 36 can slide along a valve axis 60 in response to movement of the rocker button 40 to route flow from the passageway 54 to either the aerator cartridge 26 or the outlet ring 30. The diverter valve assembly 36 includes a spool-like valve member 62 with a narrow neck 64 and a head 66. The valve member 62 carries suitable o-rings or seals (in associated circumferential grooves) on both its body to prevent water from flowing out through opening 22 and on its head 66 to seal so that each of two seal surfaces of the head o-ring can be alternately seated against the valve seats 39 and 41 when routing flow to the outlet ring 30. The valve member 62 also has a circumferential groove 67 in an intermediate portion of its body for engagement with the diverter rocker button, as described below.

Figure 7:
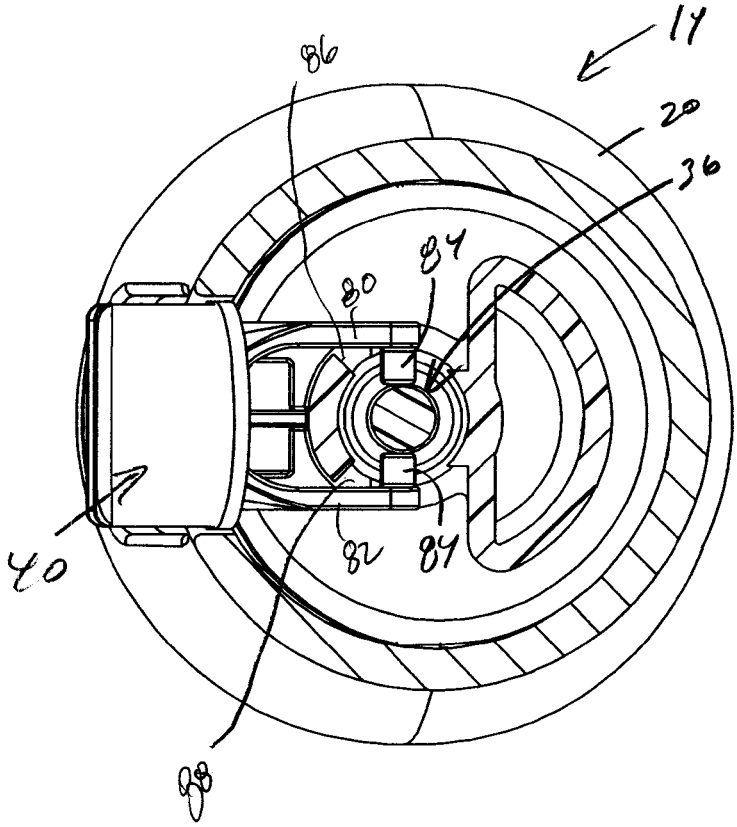
FIG. 7 is an end sectional view taken along line 7-7 of FIG. 4 s showing the interface of the diverter valve with a diverter button used to operate the diverter valve.
Figure 8:
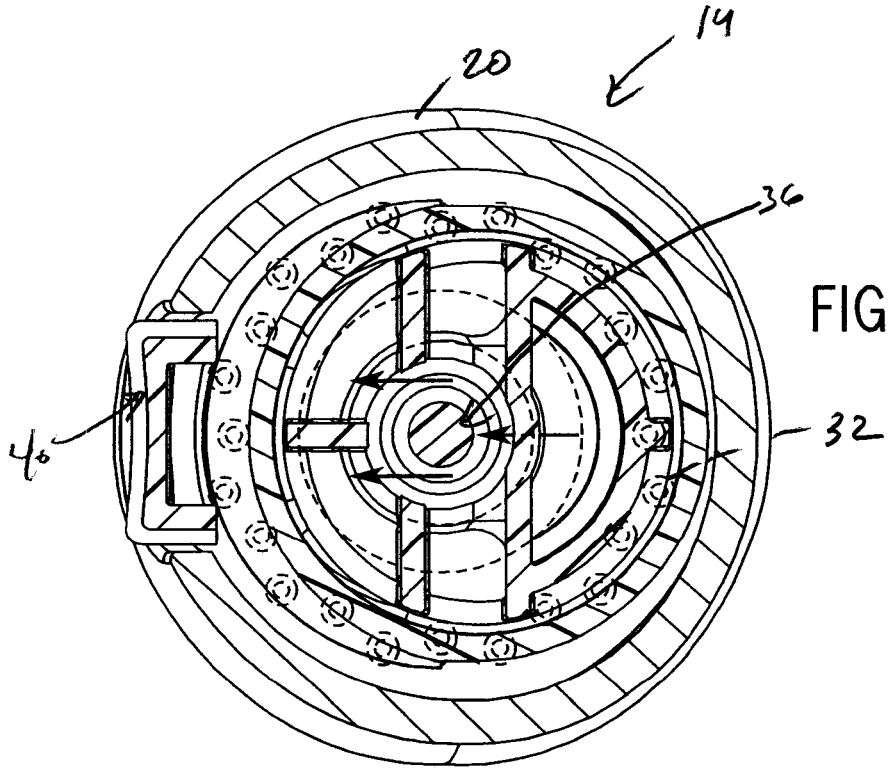
FIG. 8 is an end sectional view taken along line 8-8 of FIG. 4 showing a section of the spray head upstream from that shown in FIG. 7.

Referring now to FIGS. 3, 4 and 7, the diverter valve assembly 36 is made to translate back and forth along the valve axis 60 by pivoting the diverter rocker button 40 about an upstanding pivot post 68, integral with and extending up from the valve body 34 essentially perpendicular to the valve axis 60. The diverter rocker button 40 thus can pivot about a pivot axis 70, which extends through the center of a cylindrical section 72 of the pivot post 68, and about which a clip section 74 of the diverter rocker button 40 clips to attach it to the valve head 14. The diverter rocker button 40 is pivoted in one direction (counter-clockwise in FIG. 4) by depressing a forward section 76 of the diverter rocker button 40, which is located at the outlet side of the pivot axis 70, and in the opposite direction (clockwise in FIG. 4) by depressing an aft section 78.

The diverter rocker button 40 has two transversely depending legs 80 and 82 with small feet 84 extending laterally perpendicular to the valve axis 60 and parallel to the pivot axis 70. The legs 80 and 82 extend into respective openings 86 and 88 in the valve body 34 so that the feet 84 fit into the groove 67 in the diverter valve member 62. The legs 80 and 82 (and feet 84) can be easily formed integrally with the diverter rocker button 40. And, assembly of the diverter rocker button 40 to the valve head 14 is simplified by the legs 80 and 82 deflecting slightly as the feet 84 pass over the body of the valve member 62 before fitting into the groove 67.

Figure 5:
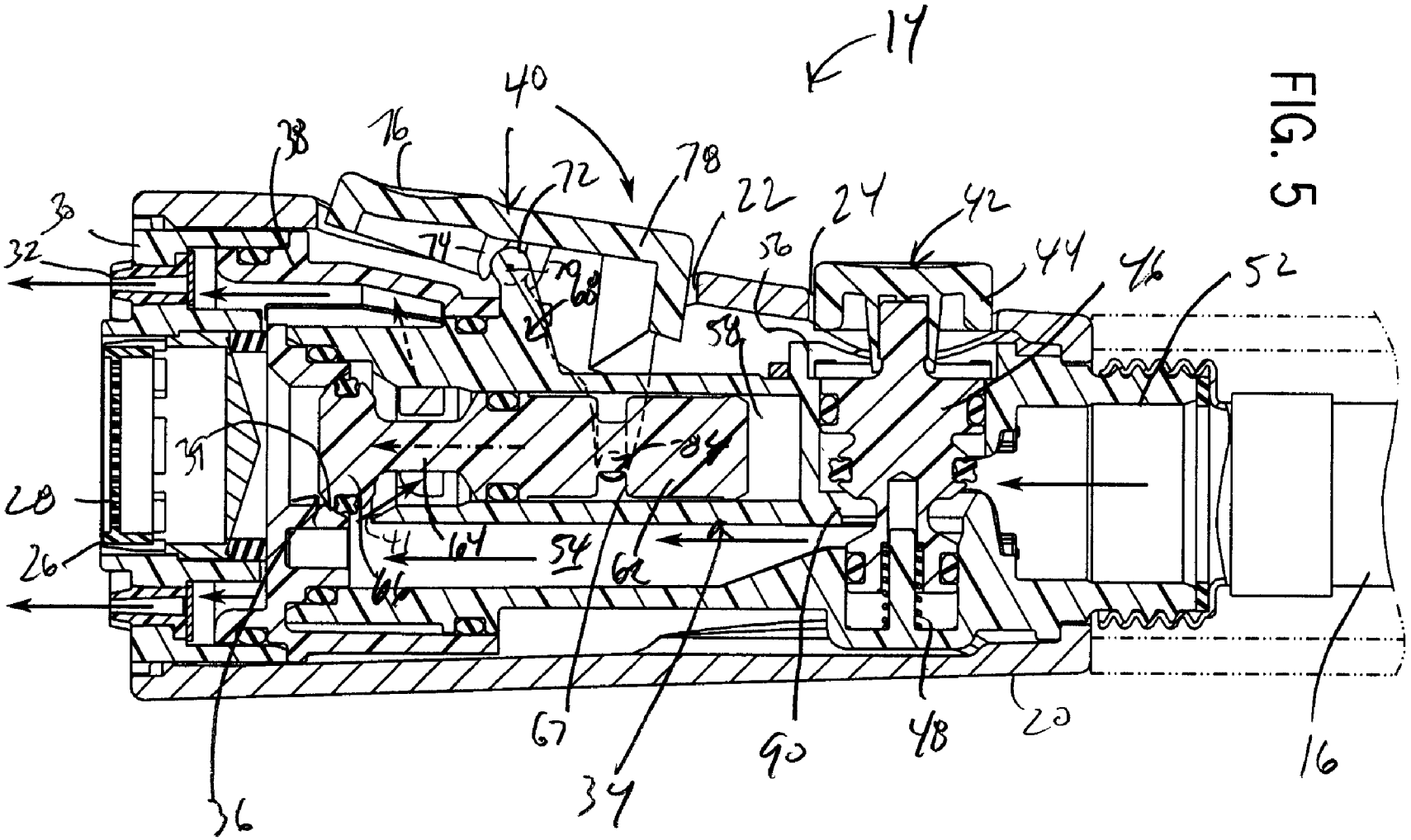
FIG. 5 is sectional view similar to FIG. 4 albeit showing the diverter valve positioned to route flow to an outer set of discharge orifices.

With reference to FIGS. 4, 5, 6 and 8, the spray head 14 operation of the spray 14 will now be described. One state of the spray head 14 is shown in FIG. 4. The spray head 14 is biased in this state by virtue of the spring 48 keeping the plunger valve member 46 of the pause assembly 42 unseated and frictional forces and/or water pressure acting on the diverter valve member 62 keeping one sealing surface of the head seal seated against valve seat 41. In this state, water can flow from the hose 16 into the valve body 34 through the inlet end 52. Water can pass into the passageway 54 through an opening 90 and around a narrowed section of the plunger valve member 46. Water flows through the passageway 54 to the center of the flow restrictor 38 and into the aerator cartridge 26. Water exits the spray head 14 through the discharge orifices 28 in the aerator cartridge 26 in a column-like pattern. Water flow is diverted from the aerator cartridge 26 to the outlet ring 30 by depressing the aft section 78 of the diverter rocker button 40 against the water pressure. This causes the legs 80 and 82 to move the feet 84 to engage the valve member 62 and drive it axially forward toward the outlet end of the spray head 14 so that the other sealing surface of the head seal seats in the valve seat 39, as shown in FIG. 5. Water is thus prevented from flowing to the aerator cartridge 26 and is routed to the discharge orifices 32 of the outlet ring 30 where it exits the spray head 14 in a shower like spray pattern.

Figure 6:
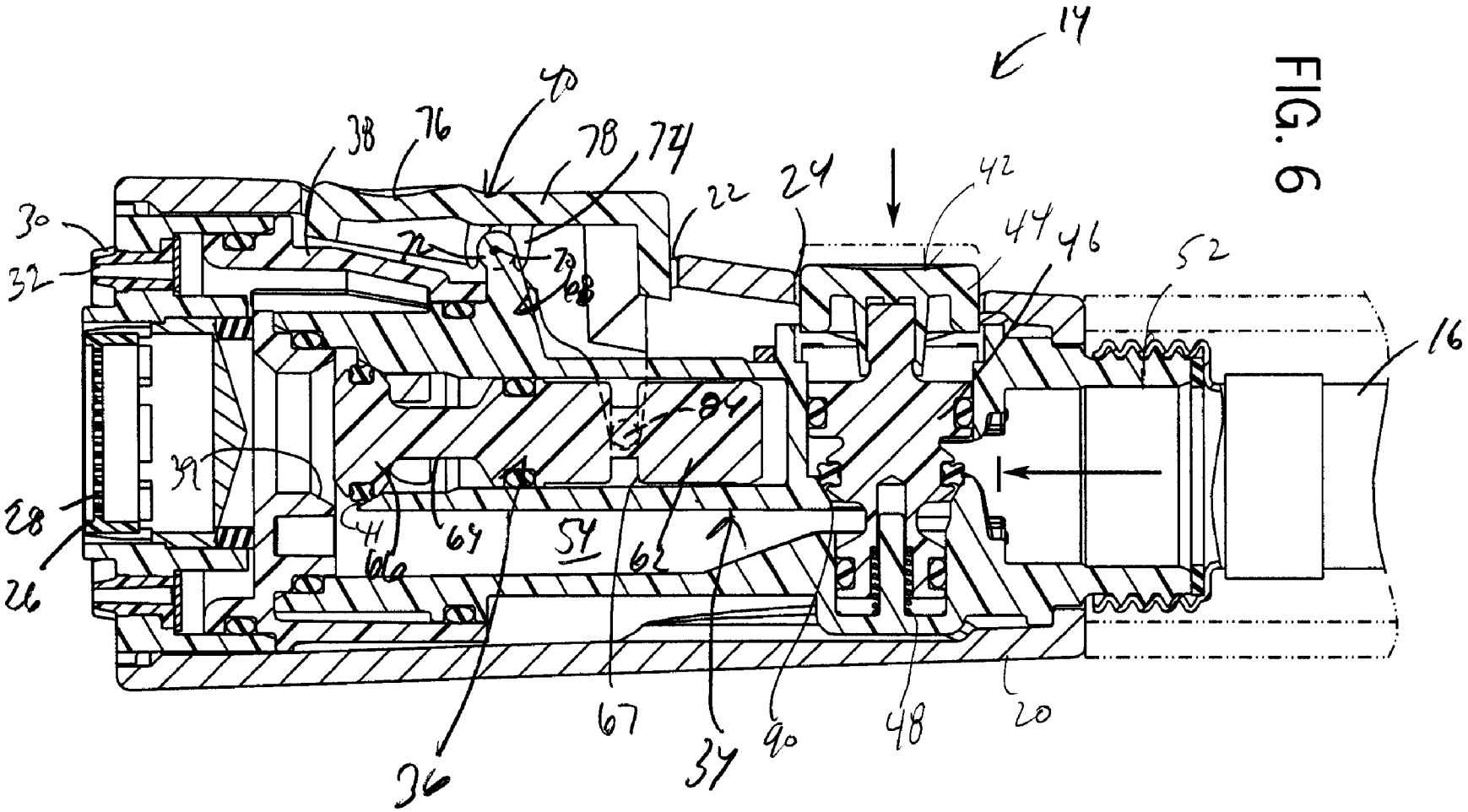
FIG. 6 is a sectional view similar to FIG. 4 albeit showing a "pause" button positioned to interrupt flow to the discharge orifices.

As shown in FIG. 6, water flow from the spray head 14 can be temporarily interrupted by depressing the pause button 44, which causes the plunger valve member 46 to move one of its seal against a seat of the opening 90 in the valve body 34 and thereby close off flow from the inlet opening 52 to the passageway 54.

It should be appreciated that a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

INDUSTRIAL APPLICABILITY

The invention provides an improved spray head suitable for a pull-out faucet having spray selection and pause controls.

What is claimed is:

1. A spray control assembly for a faucet having a faucet body and a spray head in communication with a water line, the assembly comprising:

a hollow spray head body with a button opening;

a valve body disposed in the spray head body and having an axial valve cavity and an inlet opening for communicating water from the water line through a passage to an outlet opening in an axial direction aligned with the axial cavity;

a diverter valve disposed in the axial cavity of the valve body and slideable along a valve axis in alignment with the flow of water through the spray head, the diverter valve having first and second sealing surfaces at one end and a circumferential groove;

first and second valve seats disposed at the outlet opening concentric with the valve axis for mating with the respective first and second sealing surfaces of the diverter valve;

a diverter button accessible through the button opening in the spray head body, the diverter button being pivotally mounted to the valve body to allow the diverter button to rock between first and second angular positions, the diverter button having a pair of legs extending transversely with respect to the valve axis at opposite sides of the valve body and having feet extending beyond an inner edge of each leg in a direction that is essentially parallel to the pivot axis and wherein the feet mate with the circumferential groove in the diverter valve through openings in the valve body; and an outlet mounted at an open end of the spray head body, the outlet having spray orifices, including a first set of spray orifices and a second set of spray orifices;

wherein when the diverter button is in the first angular position the first sealing surface of the diverter valve is seated in the first valve seat and water can pass from the valve body to the first spray orifices and when the diverter button is in the second angular position the second sealing surface of the diverter valve is seated in the second valve seat and water can pass from the valve body to the second spray orifices.

2. The assembly of claim 1, further including a pause button mounted to the spray head body for temporarily interrupting flow to the outlet when depressed.

3. The assembly of claim 2, wherein the pause button is accessible through an opening in the spray head body, the pause button being operably connected to a pause valve disposed along a second valve axis that is essentially perpendicular to the valve axis of the diverter valve.

4. The assembly of claim 3, wherein the pause valve is spring biased.

5. A spray control assembly for a faucet having a faucet body and a spray head in communication with a water line, the assembly comprising:

a hollow spray head body with a button opening;

a valve body disposed in the spray head body and having an axial valve cavity and an inlet opening for communicating water from the water line through a passage to an outlet opening in an axial direction aligned with the axial cavity;

a diverter valve disposed in the axial cavity of the valve body and slideable along a valve axis in alignment with the flow of water through the spray head, the diverter valve having first and second sealing surfaces at one end and a circumferential groove;

first and second valve seats disposed at the outlet opening concentric with the valve axis for mating with the respective first and second sealing surfaces of the diverter valve;

a diverter button accessible through the button opening in the spray head body, the diverter button being pivotally mounted to the valve body to allow the diverter button to rock between first and second angular positions, the diverter button having a pair of legs extending transversely with respect to the valve axis at opposite sides of the valve body and having feet extending beyond an inner edge of each leg in a direction that is essentially parallel to the pivot axis and wherein the feet mate with the circumferential groove in the diverter valve through openings in the valve body;

an outlet mounted at an open end of the spray head body, the outlet having spray orifices, including a first set of spray orifices and a second set of spray orifices, wherein when the diverter button is in the first angular position the first sealing surface of the diverter valve is seated in the first valve seat water can pass from the valve body to the first spray orifices and when the diverter button is in the second angular position the second sealing surface of the diverter valve is seated in the second valve seat and water can pass from the valve body to the second spray orifices; and a pause assembly for temporarily interrupting flow to the outlet when depressed, wherein the pause assembly includes a pause button accessible through an opening in the spray head body, the pause button being operably connected to a pause valve disposed along a second valve axis that is essentially perpendicular to the valve axis of the diverter valve, the pause valve having an associated sealing surface and being movable between a first position in which the associated sealing surface seats against an associated valve seat so as to close off flow from the inlet opening of the valve body to the outlet opening of the valve body and a second position in which the associated sealing surface is unseated from the associated valve seat so as to allow flow to pass from the inlet opening of the valve body to the outlet opening of the valve body.

6. The assembly of claim 5, wherein the pause valve is spring biased to the second position.

7. A spray control assembly, comprising:

a spray head body having a button opening and an outlet with first and second sets of spray orifices;

a valve body disposed in the spray head body;

a diverter valve disposed in the valve body and having first and second sealing surfaces and a circumferential groove;

first and second valve seats disposed for mating with the respective first and second sealing surfaces of the diverter valve;

a diverter button accessible through the button opening in the spray head body and pivotally mounted to the valve body, the diverter button having at least one leg extending along at least one side of the valve body and having at least one foot extending beyond an inner edge of the at least one leg in a direction that is essentially parallel to the pivot axis such that the at least one foot mates with the circumferential groove in the diverter valve through at least one opening in the valve body; and wherein when the diverter button is in a first angular position the first sealing surface of the diverter valve is seated in the first valve seat to open communication from the valve body to the first spray orifices and when the diverter button is in a second angular position the second sealing surface of the diverter valve is seated in the second valve seat to open communication from the valve body to the second spray orifices.

8. The assembly of claim 7, wherein the valve body defines an axial cavity and the diverter valve moves within the axial cavity along a valve axis.

9. The assembly of claim 7, further including a pause button mounted to the spray head body for temporarily interrupting flow to the outlet when depressed.

10. The assembly of claim 9, wherein the pause button is accessible through an opening in the spray head body, the pause button being operably connected to a pause valve disposed essentially perpendicular to the diverter valve.

11. The assembly of claim 10, wherein the pause valve is spring biased.

* * * * *